US007604149B2

(12) United States Patent
Tsai et al.

(10) Patent No.: US 7,604,149 B2
(45) Date of Patent: Oct. 20, 2009

(54) EFFORT-SAVING STAPLER

(75) Inventors: Eric Tsai, Tali (TW); Pi-Yi Chang, Tali (TW); Chih-Wei Hu, Taichung (TW)

(73) Assignee: APEX Mfg. Co., Ltd., Tali (TW)

( * ) Notice: Subject to any disclaimer, the term of this patent is extended or adjusted under 35 U.S.C. 154(b) by 72 days.

(21) Appl. No.: 12/023,091

(22) Filed: Jan. 31, 2008

(65) Prior Publication Data

US 2008/0223901 A1 Sep. 18, 2008

Related U.S. Application Data

(63) Continuation-in-part of application No. 11/686,798, filed on Mar. 15, 2007.

(51) Int. Cl.
*B25C 1/04* (2006.01)

(52) U.S. Cl. ..... 227/132; 227/134

(58) Field of Classification Search ..... 227/132, 227/134, 109, 120, 131
See application file for complete search history.

(56) References Cited

U.S. PATENT DOCUMENTS

| | | | | | |
|---|---|---|---|---|---|
| 1,457,446 | A | | 6/1923 | Michener | 227/132 |
| 1,757,812 | A | | 5/1930 | Polzer | 227/132 |
| 2,493,640 | A | | 1/1950 | Peterson | 227/132 |
| 2,603,782 | A | | 7/1952 | Spencer | 227/132 |
| 3,199,185 | A | * | 8/1965 | Lash et al. | 29/434 |
| 3,229,882 | A | | 1/1966 | Abrams | 227/132 |
| 3,275,212 | A | | 9/1966 | Johnson | 227/132 |
| 3,491,578 | A | | 1/1970 | Biermann | 29/243.521 |
| 3,610,505 | A | | 10/1971 | Males et al. | 227/127 |
| 3,753,524 | A | | 8/1973 | Heyward | 227/132 |
| 4,119,258 | A | * | 10/1978 | Ewig, Jr. | 227/132 |
| 4,126,260 | A | | 11/1978 | Mickeisson | 227/132 |
| 4,358,043 | A | * | 11/1982 | Chi | 227/155 |
| 4,450,998 | A | | 5/1984 | Ruskin | 227/8 |
| 4,699,307 | A | * | 10/1987 | Kozyrski et al. | 227/132 |
| 5,131,580 | A | * | 7/1992 | Allman | 227/132 |
| 5,165,587 | A | * | 11/1992 | Marks | 227/132 |
| 5,335,839 | A | | 8/1994 | Fealey | 227/132 |
| 5,758,813 | A | * | 6/1998 | Kikuchi et al. | 227/155 |
| 5,937,951 | A | * | 8/1999 | Izuchukwu et al. | 227/176.1 |
| 5,979,736 | A | | 11/1999 | Edeholt | 227/132 |
| 7,097,088 | B2 | * | 8/2006 | Shor | 227/132 |
| 7,124,924 | B2 | * | 10/2006 | Marks | 227/120 |
| 7,395,955 | B2 | * | 7/2008 | Zins et al. | 227/132 |

OTHER PUBLICATIONS

Taiwan Patent No. 576290, Feb. 11, 2004, 6 pages.

* cited by examiner

*Primary Examiner*—Scott A. Smith
(74) *Attorney, Agent, or Firm*—Alan Kamrath; Kamrath & Associates PA

(57) ABSTRACT

An effort-saving stapler includes a shell device and a triggering device installed to the shell device. The triggering device includes a trigger, an operation element and two bearings. An end of the trigger defines a lever for user to hold, and another end of the trigger includes teeth engaging with the shell device. A pivot pin is adapted for inserting through the trigger, the operation element and the bearings so that the pivot pin can drive the operation element to move in the trigger. A limit pin is adapted for inserting through the trigger and the operation element and abuts with the shell device. The pivot pin is regarded as a fulcrum, while the trigger is pressed, the teeth of trigger engage with the shell device so that the pivot pin quickly moves with the trigger.

9 Claims, 8 Drawing Sheets

EFFORT-SAVING STAPLER

CROSS-REFERENCE

The present patent application is a continuation-in-part application of U.S. patent application Ser. No. 11/686,798, filed Mar. 15, 2007, pending.

BACKGROUND OF THE INVENTION

The present invention relates to an effort-saving stapler.

As disclosed in Taiwanese Patent Publication No. 576290, a conventional stapler 10 includes a shell 20 and a mechanism 30. The shell 20 includes two halves. The mechanism 30 includes a hammer 31, a leaf spring 32 and a trigger 33. The hammer 31 is movably disposed in the shell 20. The leaf spring 32 is disposed in the shell 20. The leaf spring 32 is connected to the hammer 31. The trigger 33 is connected to the shell 20 by a pin 34. A tongue 35 is connected to the trigger 33 by a pin 37. The tongue 35 is biased by a torque spring 36. The tongue 35 is normally inserted in an aperture 311 defined in the hammer 31. To staple, a user pulls the trigger 33. The tongue 35 lifts the hammer 31 that loads the leaf spring 32. Having fully pulled the trigger 33, the user causes the tongue 35 to leave the hammer 31. The leaf spring 32 drives the hammer 31 down to hit the nail. The user however has to pull the trigger 33 harder and harder. The user has to pull the trigger 33 hard so that he soon feels tired.

The present invention is therefore intended to obviate or at least alleviate the problems encountered in prior art.

SUMMARY OF THE INVENTION

According to the present invention, an effort-saving stapler includes a shell device and a triggering device. The shell device consists of two halves and a front shell and further includes a magazine, a hammer, a block and a power spring. The triggering device includes a trigger, an operation element, two bearings, a pivot pin and a limit pin. The magazine is disposed in the bottom of the shell device for supporting and feeding staples. The hammer is disposed against the front shell for hammering the staples, one at a time. The block is received in the top of each half. The power spring is disposed in the shell device for biasing the hammer. The trigger is movably and pivotally connected to the shell device and engaged with the block via teeth of the trigger and teeth of the block. The operation element includes a driving portion connected to the hammer, a pivot pin and a limit pin. The bearings are respectively slideably installed on the halves. The pivot pin is adapted for inserting through the trigger and the operation element and connects to the bearings. The bearings can be driven by the pivot pin of the triggering device. The limit pin is adapted for insert through the trigger and the operation element. And two ends of the limit pin respectively abut with the interior surface of the halves. When the trigger is operated, the hammer is lifted by the operation element and the fulcrum, pivot pin is moved towards the hammer. Therefore, during a user is pressing the trigger, he can exert less force to operate the stapler to eject staples.

An advantage of the effort-saving stapler is to provide an effort-saving operation since a user does not have to pull the trigger hard.

Another advantage of the effort-saving stapler is to provide an efficient operation since the user can use the effort-saving stapler for a long time without having to rest.

Other advantages and features of the present invention will become apparent from the following description referring to the drawings.

BRIEF DESCRIPTION OF THE DRAWINGS

The present invention will be described via detailed illustration of the preferred embodiment referring to the drawings.

DETAILED DESCRIPTION OF THE PREFERRED EMBODIMENT

Figure 1:
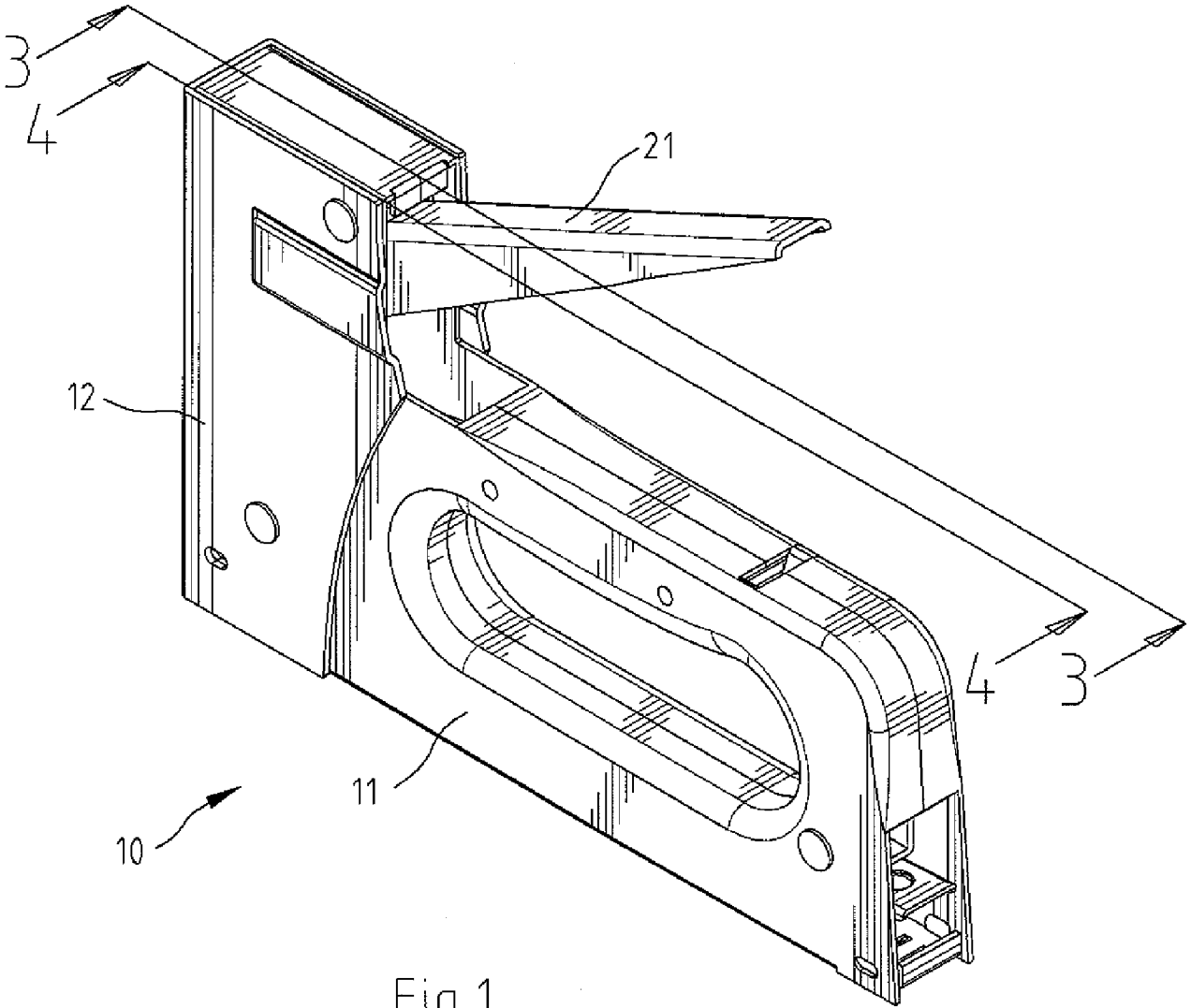
FIG. 1 is a perspective view of an effort-saving stapler according to the first embodiment of the present invention.
Figure 2:
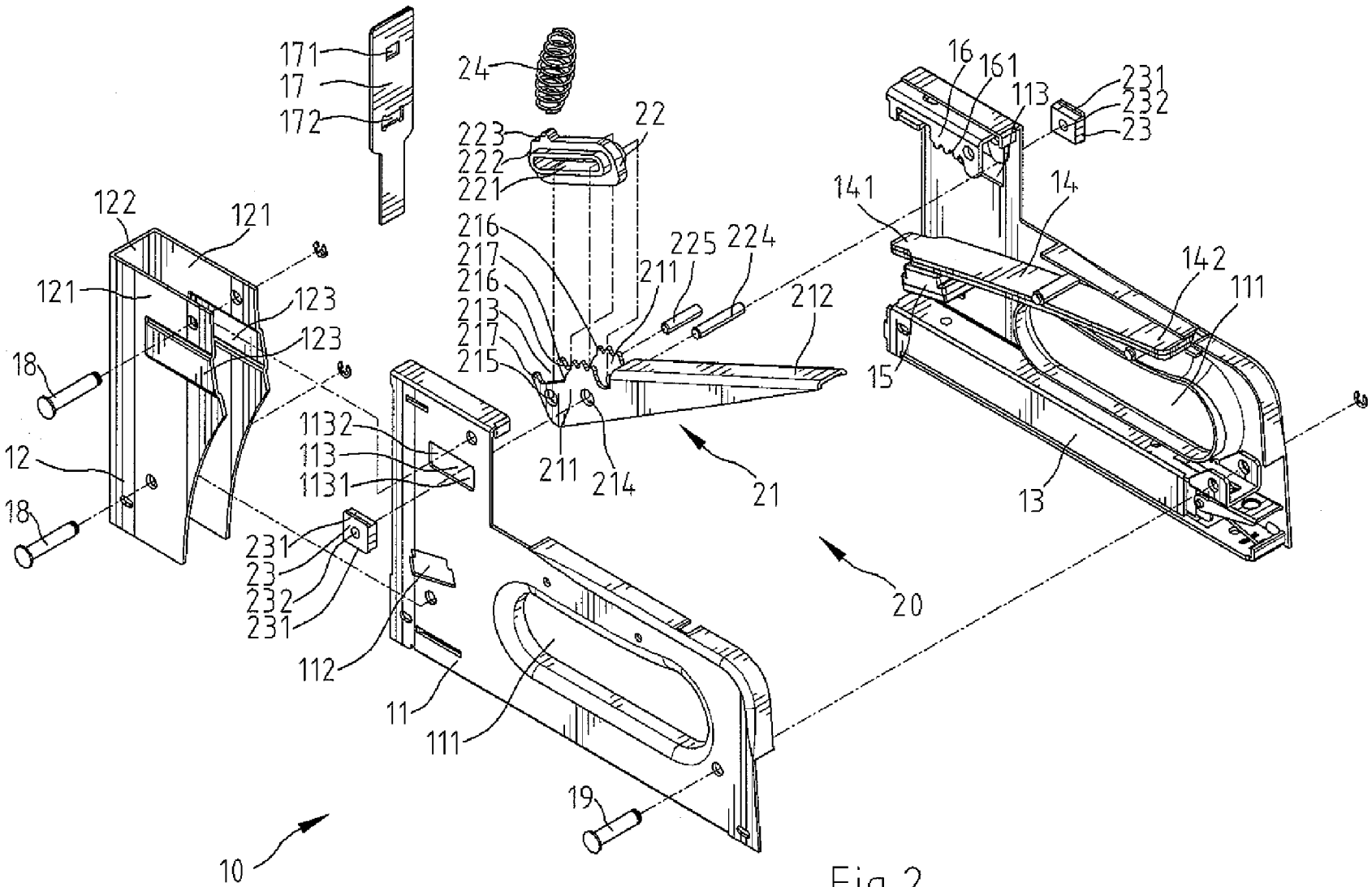
FIG. 2 is an exploded view of the effort-saving stapler shown in FIG. 1.

Referring to FIGS. 1 and 2, an effort-saving stapler includes a shell device 10 and a trigger device 20 according to a first embodiment of the present invention.

The shell device 10 consists of two halves 11 and a front shell 12, with the front shell 12 covering on the front of each half 11 while two halves 11 couple to each other.

The front shell 12 is preferably U-shaped, and includes two sidewalls 121, a front wall 122 contiguously connected with each sidewall 121, a track 123 defined on each sidewall 121 and relative to a track groove 113 of each half 11, and a recess 124 formed on the inner surface of the front wall 122. The front shell 12 is installed to the halves 11 with respect to a number of coupling elements 18, and two halves 11 combined to each with respect to a number of coupling elements 19. Both the track 123 and the recess 124 are formed via pressing.

The shell device 10 further includes a magazine 13 installed in the bottom of each half 11, a hammer 17 movably disposed in the shell device 10 against the front wall 122 and having a first aperture 171 and a second aperture 172 below the first aperture 171, a power spring 14 having a first end 141 inserted through the second aperture 172 of the hammer 17 to the recess 124 of the front shell 12 and a second end 142 defined opposite to the first end 141 and secured to a portion of the interior thereof a buffer 15 disposed therein between the power spring 14 and the magazine 13 and abutting the first end 141 of the power spring 14, and a block 16 disposed therein against the top surface thereof.

The block 16 includes teeth 161 formed on the bottom thereof with the teeth 161 arranged straightly. The hammer 17 is biased by the power spring 14. The buffer 15 provides to deaden the resilience force of the power spring 14 for noise reduction. Staples are carried and fed by the magazine 12 disposed in the shell device 10 and ejected, one at a time, by the hammer 17.

Each half 11 includes a held portion 111 formed on the body thereof opposite to the front shell 12 and providing for users to hold, a hole 112 formed thereon adjacent to the front shell 12, and the track groove 113 formed thereon and above the hole 112. The magazine 13 is disposed below each held portion 111, and the hammer 17 forms an insert end (not numbered) opposite to the first and second apertures 171, 172, with the end of the hammer 17 inserting into the head of the magazine 13 for ejecting staples. The buffer 15 is disposed in each hole 112 while two halves 11 couple to each other. Each track groove 113 has a first end 1131 and a second end 1132.

The triggering device 20 is installed in the shell device 10 adjacent to the block 16 and includes a trigger 21, an operation element 22, two bearings 23 and an elastic element 24.

The trigger 21 includes two walls 211 formed on an end thereof and spaced from each other, a lever 212 defined on another end thereof opposite to the walls 211, and a space 213 defined between the walls 211. Each wall 211 includes teeth 216 and a projection 217 formed on an arched upper edge thereof with the projection 217 spaced from the teeth 216 and defined on the distal of the trigger 21. A first pivot hole 214 is defined on each wall 211 and right below the teeth 216, and a second pivot hole 215 is defined on each wall 211 and adjacent to the projection 217. The teeth 216 are arranged along the arched upper edge of each wall 211 and correspond to the teeth 161 of the block 16 for engaging with the teeth 161.

The operation element 22 is disposed in the space 213 of the trigger 21 and includes a track groove 221, a driving portion 222 formed on an end thereof and inserted into the first aperture 171 for driving the hammer 17, and a projection 223 formed on the top thereof. The elastic element 24 is mounted on the projection 223 and abuts against the block 16 so that the elastic element 24 can be stably received in the shell device 10. The track groove 221 corresponds to the first and second pivot holes 214, 215 and the track groove 113. The operation element 22 further includes a pivot pin 224 inserted through the first pivot holes 214 to the track grooves 113 of each half 11, and a limit pin 225 inserted through the second pivot holes 215. Then, two ends of the limit pin 225 abut with the interior wall of each half 11.

Each bearing 23 is slideably installed on the track groove 113 of each half 11 and includes two flanges 231 respectively formed from the upper and lower edges of a side thereof and a through-hole 232 defined in the center thereof. The through-holes 232 are provided to receive two ends of the pivot pin 224 respectively so that the bearings 23 can be driven via the trigger 21. The flanges 231 can prevent the bearing 23 detaching from the track groove 113 of each half 11.

Figure 3:
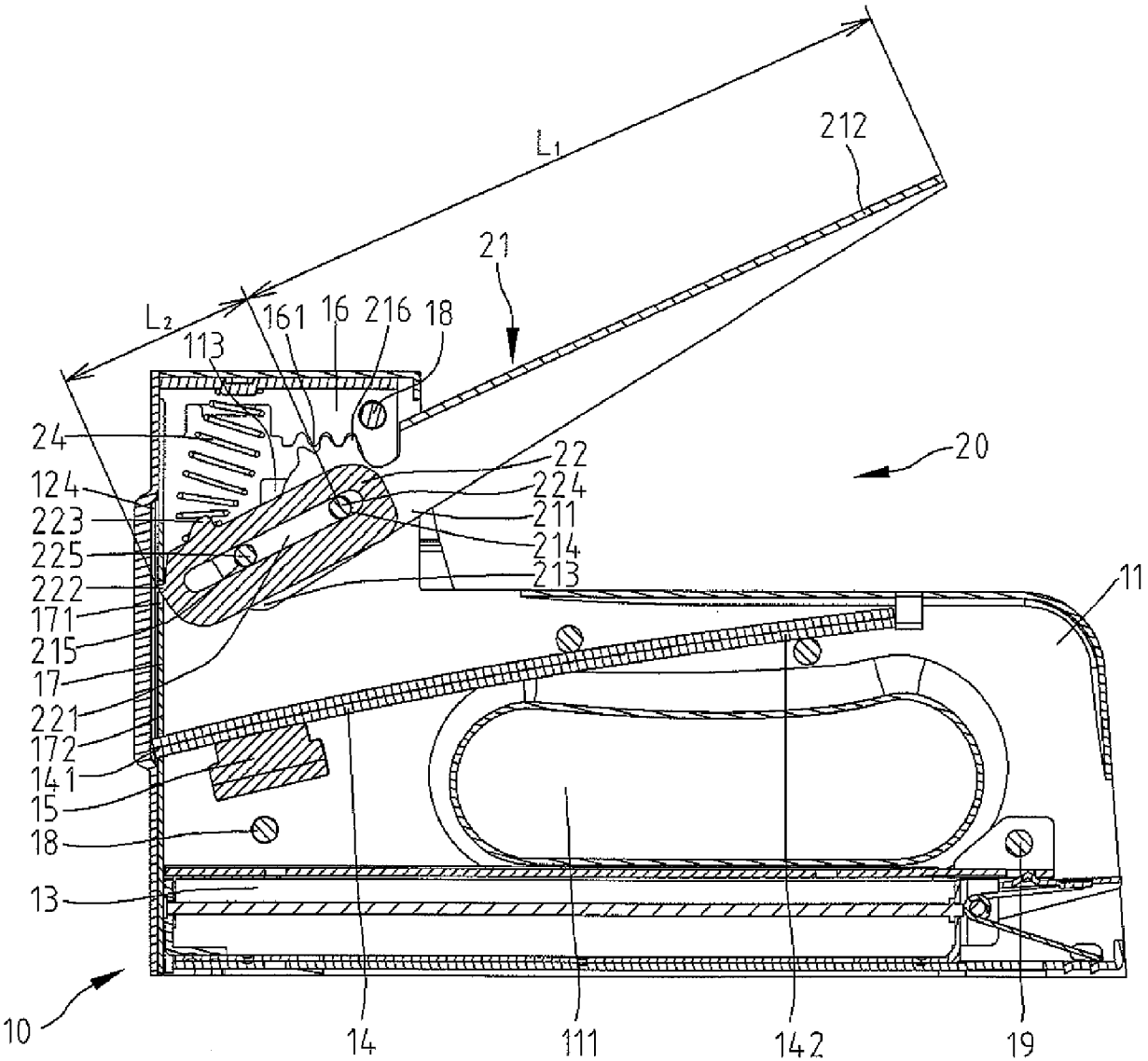
FIG. 3 is a cross-sectional view of the easy stapler taken along a line 3-3 shown in FIG. 1.
Figure 4:
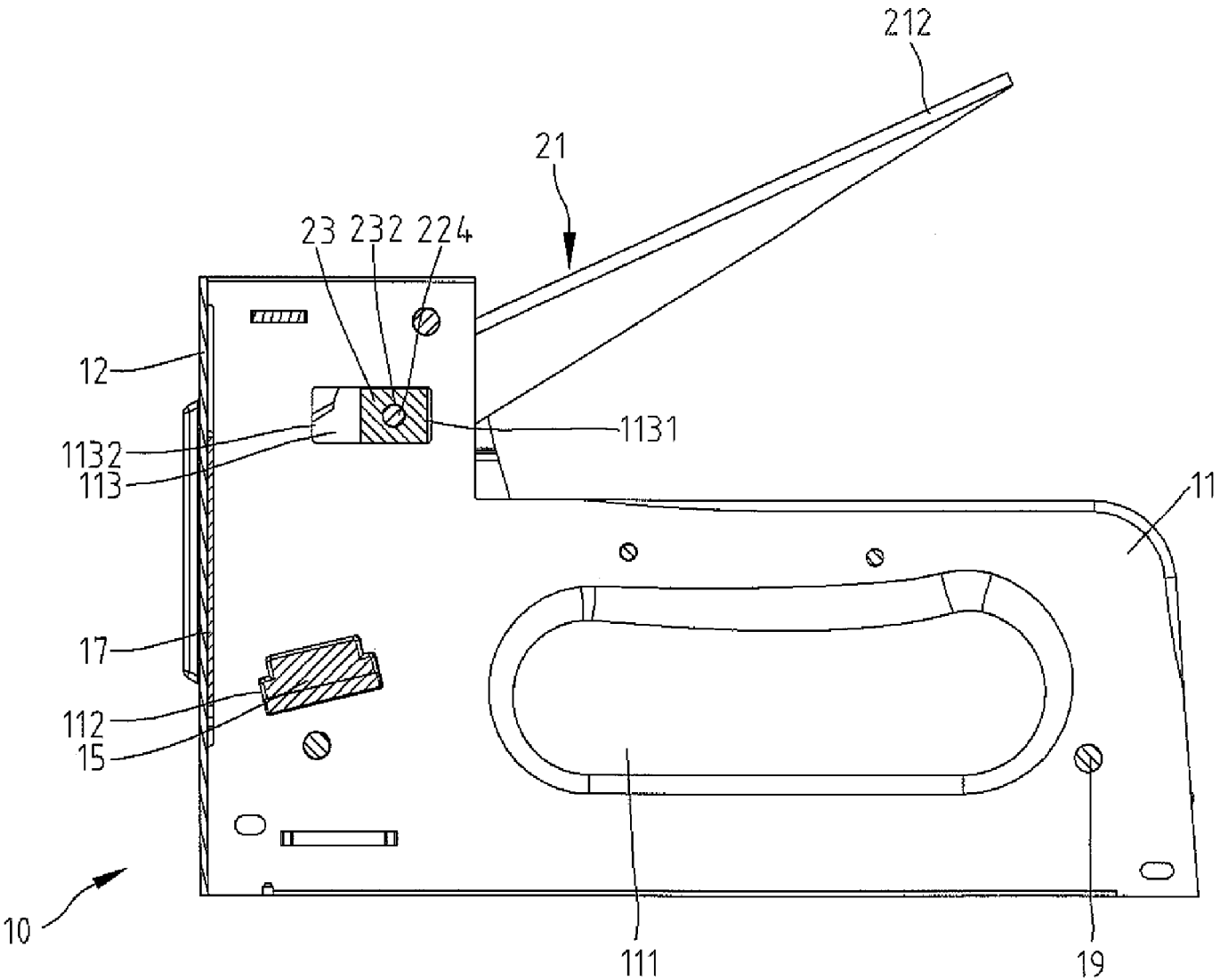
FIG. 4 is a cross-sectional view of the easy stapler taken along a line 4-4 shown in FIG. 1.

Referring to FIGS. 3 and 4, it shows the effort-saving stapler is not operated yet. The elastic element 24 is released and presses the projection 223 of the operation element 22 so that the lever 212 of the trigger 21 is driven to be lifted. Next, the horizontal position of the pivot pin 224 is higher than that of the limit pin 225. Therefore, the operation element 22 is inclined and slides toward the hammer 17, and the each bearing 23 abuts against the first end 1131 of the track groove 113. The teeth 216 engage with the rightmost end of the teeth 161, the hammer 17 is driven by the driving portion 222 of the operation element 22 inserting through the first aperture 171 of the hammer 17, and the first end 141 of the power spring 14 inserts through the second aperture 172 of the hammer 17 and is received in the recess 124 of the front shell 12.

However, when the teeth 216 is driven to engage with the left of the teeth 161 and the pivot pin 224 drives each bearing 23 to slide in the track groove 113, because the distance between the pivot pin 224 and the limit pin 225 is constant, the limit pin 225 is driven by the trigger 21 and moves between the halves 11 relative to the pivot pin 224. The operation element 22 is restricted in the space 213 between the walls 211, and the movement of the operation element 22 is limited by the pivot pin 224 and the limit pin 225.

User exerts force to the lever 212 of the trigger 21, and the trigger 21 pivots on the pivot pin 224 that is moveable in the track groove 221 and regarded as a fulcrum. Then, a resistant force is generated on the driving portion 222 that inserts to the hammer 17. There is a distance L1, the exert force arm, measured from the pivot pin 224 to the lever 212 of the trigger 21. There is another distance L2, the resistant force arm, measured from the pivot pin 224 to the driving portion 222 where driving portion 222 is in contact with the hammer 17.

Figure 5:
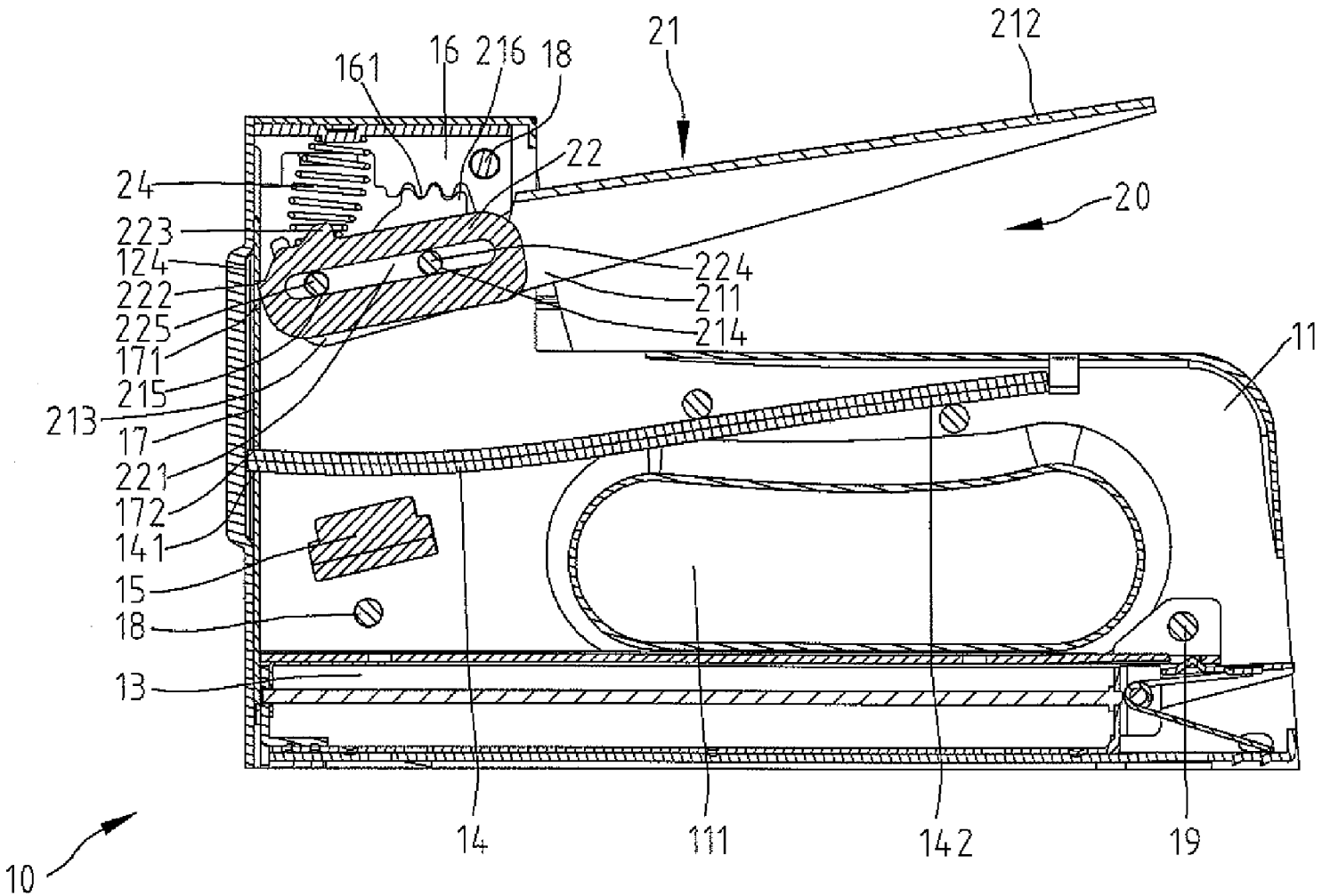
FIG. 5 is a cross-sectional view of the easy stapler similar to FIG. 3.
Figure 6:
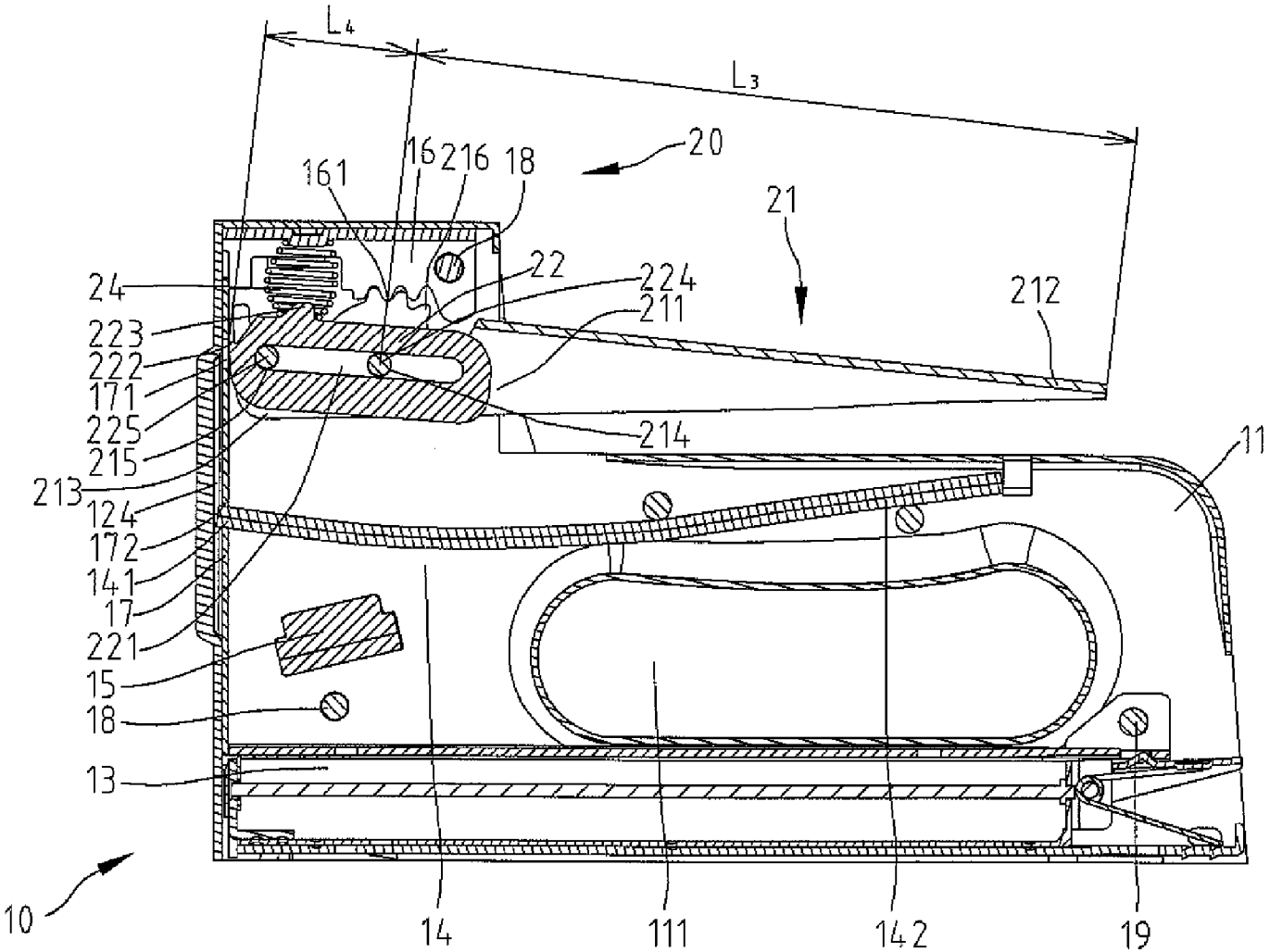
FIG. 6 is another cross-sectional view of the easy stapler similar to FIG. 3.
Figure 7:
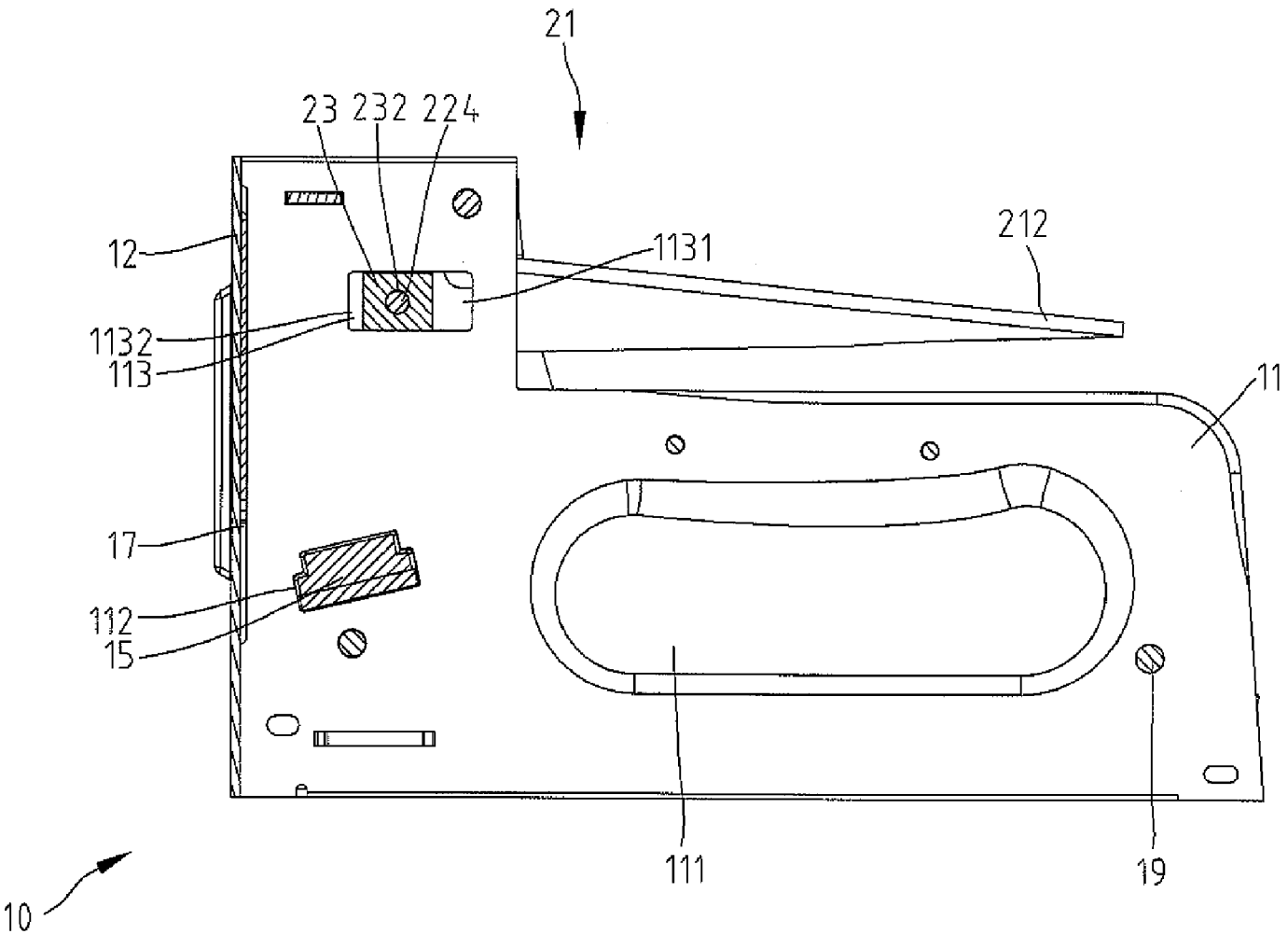
FIG. 7 is a cross-sectional view of the easy stapler similar to FIG. 4.

Referring to FIGS. 5 through 7, it shows that the stapler is operated. The trigger 21 is pressed, and the teeth 216 engage with the teeth 161. The engagement of the teeth 216 and 161 is changeable by pressing the trigger 21 downwardly. The pivot and limit pins 224, 225 drive the operation element 22 to change position between the walls 211 quickly. The pivot pin 224 quickly moves in the track groove 221 by the lever 212 of trigger 21 pressed downwardly continuously so that the driving portion 222 of the operation element 22 is driven to rise to lift the hammer 17. And the projection 223 of the operation element 22 presses upwardly the elastic element 24. Then, the hammer 17 lifts the first end 141 of the power spring 14. The fulcrum, the pivot pin 224, changes its position in the track groove 221 and then, each bearing 23 moves toward the second end 1132 of the track groove 113, and the limit pin 225 abuts with the extreme end of the track groove 221. Subsequently, the driving portion 222 detaches from the first aperture 171 of the hammer 17, and the lever 212 of the trigger 21 returns to the original position with respect to the released elastic element 24. The hammer 17 is driven to fall to the magazine 15 to eject staple by the resilience of the power spring 14.

While the stapler is operated by pressing the lever 212 of the trigger 21, the engagement point of the teeth 216 and the teeth 161 is changed. The fulcrum, the pivot pin 224, moves toward the hammer 17 so that the distance L1 gets longer and the distance L2 gets shorter. Therefore, the ratio of the distance L1 to the distance L2 increases so that the user does not have to pull the trigger 21 much harder from the position shown in FIG. 3 through the position shown in FIG. 5 to the position shown in FIG. 6.

Figure 8:
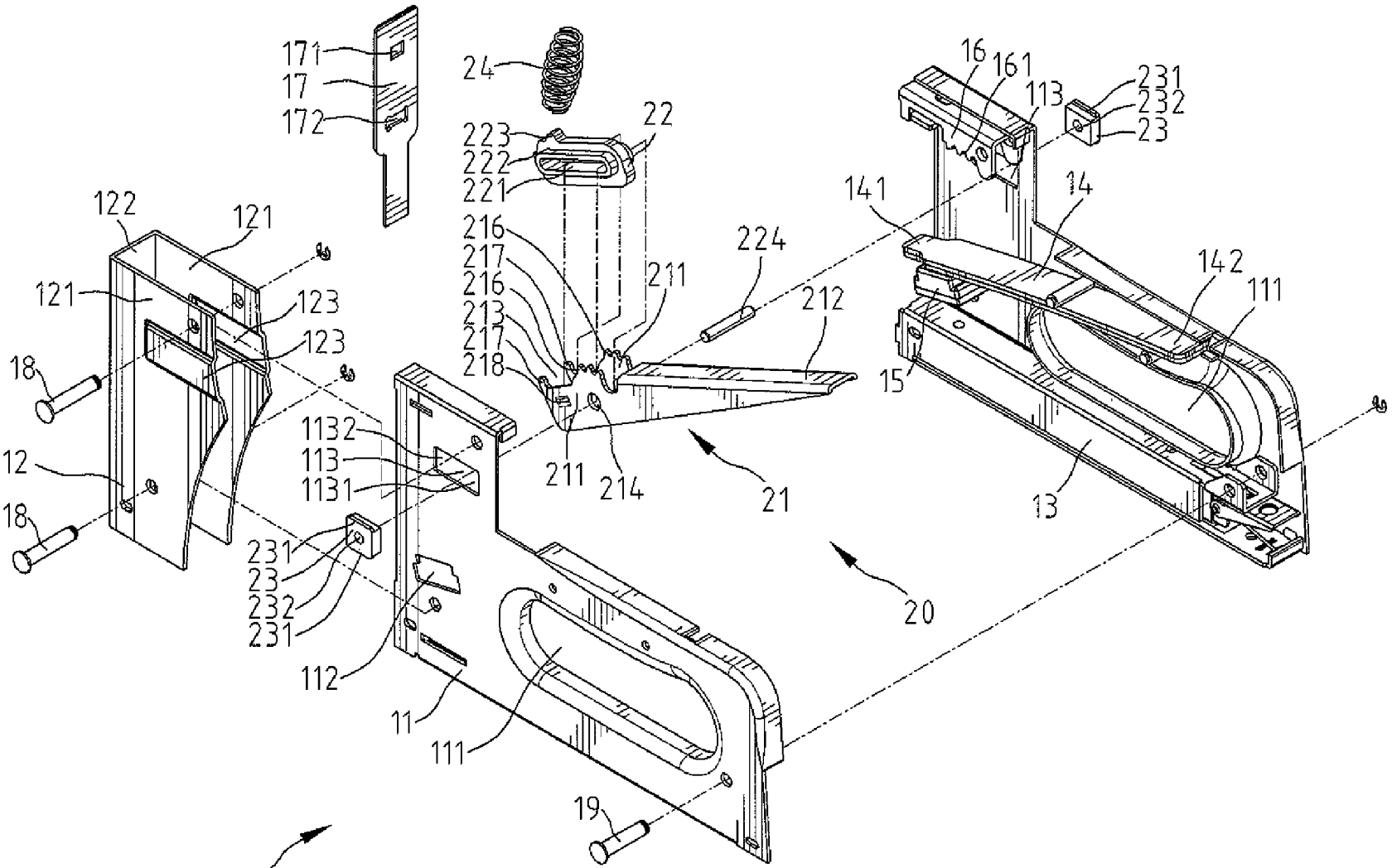
FIG. 8 is a perspective view of an effort-saving stapler according to the second embodiment of the present invention.

Referring to FIG. 8, it shows an effort-saving stapler according to a second embodiment of the present invention. The second embodiment is similar to the first embodiment expect that the trigger 21 further includes two limit portions 218 that replace the second pivot holes 215 and the limit pin 225 to restrict the operation element 22 in the space 213. Each limit portion 218 is formed on each wall 211 and protrudes toward the space 213.

An advantage of the effort-saving stapler is therefore to provide an effort-saving operation since the user does not have to pull the trigger hard.

Another advantage of the effort-saving stapler is to provide an efficient operation since the user can use the effort-saving stapler for a long time without having to rest.

Another advantage of the effort-saving stapler is the operation element can be driven to move quickly by the engagement of the teeth of the trigger and the teeth of the block of shell device so that the hammer can be driven to eject staples quickly.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. An effort-saving stapler comprising:

a shell device consisting of two halves and a front shell, wherein each half forms a track groove;

a magazine disposed in the halves for supporting and feeding staples;

a hammer disposed in the halves for hammering the staples, one at a time;

a power spring disposed in the shell for biasing the hammer;

a block disposed in the halves, wherein the block comprises teeth formed thereon;

a triggering device including a trigger pivotally connects to the shell device, an operation element and two bearings respectively installed to the track grooves slideably, wherein the trigger includes two walls formed on an end thereof and spaced from each other, a first pivot hole formed each wall, and teeth formed on one of the walls and engaging with the teeth of the block;

wherein the operation element is disposed in the space and includes a track groove and a driving portion inserting in the hammer; and a pivot pin inserted through the first pivot holes and the track groove to the bearings;

wherein the pivot pin is driven to move relative to the trigger and drives the operation element via pressing the trigger downwardly so that when the trigger is operated, the hammer is lifted by the operation element and the pivot pin is moved towards the hammer.

2. The effort-saving stapler according to claim 1 the triggering device further comprising a limit pin and two second pivot holes formed on two walls thereof; wherein the limit pin inserts through the second pivot holes and the track groove of the triggering device and abuts the interior surface of the shell device.

3. The effort-saving stapler according to claim 1 wherein each bearing forms a through-hole for the pivot pin inserting to, and two flanges on a side of the upper and lower edges thereof.

4. The effort-saving stapler according to claim 1 wherein the front shell defines two tracks formed on two sidewalls thereof respectively and corresponding to the track grooves of the halves.

5. The effort-saving stapler according to claim 1 further comprising a space between the walls of the trigger.

6. The effort-saving stapler according to claim 1 further comprising a buffer disposed in the shell device, with an end of the power spring adapted to abut with the buffer.

7. The effort-saving stapler according to claim 1 wherein the hammer includes a first aperture and a second aperture, with the power spring inserting to the second aperture, with the driving portion of the operation element inserting to the first aperture.

8. The effort-saving stapler according to claim 1 wherein the operation element includes a projection, with an elastic element adapted to be mounted on the projection and disposed between the operation element and the block.

9. The effort-saving stapler according to claim 1 wherein each wall of the trigger forms teeth thereon; wherein the teeth of the block are adapted for engaging with the teeth of each wall respectively.

* * * * *